US009580767B2

(12) United States Patent
Hata et al.

(10) Patent No.: US 9,580,767 B2
(45) Date of Patent: Feb. 28, 2017

(54) COLD-ROLLED STEEL SHEET WITH CONTROLLED MICROSTRUCTURE, GRAIN DIAMETERS, AND TEXTURE

(71) Applicant: NIPPON STEEL & SUMITOMO METAL CORPORATION, Tokyo (JP)

(72) Inventors: Kengo Hata, Tokyo (JP); Toshiro Tomida, Tokyo (JP); Norio Imai, Tokyo (JP); Jun Haga, Tokyo (JP); Takuya Nishio, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 263 days.

(21) Appl. No.: 14/379,829

(22) PCT Filed: Feb. 13, 2013

(86) PCT No.: PCT/JP2013/053313
§ 371 (c)(1),
(2) Date: Aug. 20, 2014

(87) PCT Pub. No.: WO2013/125400
PCT Pub. Date: Aug. 29, 2013

(65) Prior Publication Data

US 2015/0037610 A1 Feb. 5, 2015

(30) Foreign Application Priority Data

Feb. 22, 2012 (JP) ..... 2012-036475

(51) Int. Cl.

| | |
|---|---|
| ***C22C 38/02*** | (2006.01) |
| ***C22C 38/04*** | (2006.01) |
| ***C22C 38/14*** | (2006.01) |
| ***C22C 38/12*** | (2006.01) |
| ***C22C 38/18*** | (2006.01) |
| ***C21D 8/02*** | (2006.01) |
| ***C21D 9/46*** | (2006.01) |
| ***C22C 38/00*** | (2006.01) |
| ***C22C 38/06*** | (2006.01) |
| ***C22C 38/26*** | (2006.01) |
| ***C22C 38/38*** | (2006.01) |

(52) U.S. Cl.

CPC ..... *C21D 8/0263* (2013.01); *C21D 8/0205* (2013.01); *C21D 8/0236* (2013.01); *C21D 9/46* (2013.01); *C22C 38/00* (2013.01); *C22C 38/002* (2013.01); *C22C 38/005* (2013.01); *C22C 38/02* (2013.01); *C22C 38/04* (2013.01); *C22C 38/06* (2013.01); *C22C 38/12* (2013.01); *C22C 38/14* (2013.01); *C22C 38/18* (2013.01); *C22C 38/26* (2013.01); *C22C 38/38* (2013.01); *C21D 8/0284* (2013.01); *C21D 2211/001* (2013.01); *C21D 2211/002* (2013.01); *C21D 2211/005* (2013.01); *C21D 2211/008* (2013.01); *Y10T 428/12972* (2015.01)

(58) Field of Classification Search
None
See application file for complete search history.

(56) References Cited

U.S. PATENT DOCUMENTS

2001/0015245 A1 8/2001 Eberle et al.

FOREIGN PATENT DOCUMENTS

| | | |
|---|---|---|
| JP | 11-279690 | 10/1999 |
| JP | 2005-325393 | 11/2005 |
| JP | 2008-231480 | 10/2008 |
| JP | 2008-291304 | 12/2008 |
| JP | 2009-209451 | 9/2009 |
| JP | 2010-196115 | 9/2010 |
| JP | 2011-001579 | 1/2011 |
| JP | 2011-149066 | 8/2011 |
| JP | 2011-214081 | 10/2011 |
| WO | 2007/015541 | 2/2007 |
| WO | 2011/087057 | 7/2011 |
| WO | 2012/020511 | 2/2012 |

OTHER PUBLICATIONS

Machine-English translation of specification for JP2011-149066, Wakita Masayuki et al., Aug. 4, 2011.*
Machine-English translation of specification for JP2011-214081, Wakita Masayuki et al., Oct. 27, 2011.*
Machine-English translation of specification for JP2008-291304, Nakagaito Tatsuya et al., Dec. 4, 2008.*

* cited by examiner

*Primary Examiner* — Deborah Yee
(74) *Attorney, Agent, or Firm* — Clark & Brody

(57) ABSTRACT

A high-strength cold-rolled steel sheet includes a composition having controlled amounts of carbon, silicon, manganese, phosphorous, sulfur, titanium, niobium, sol. Aluminum, chromium, molybdenum, vanadium, boron, calcium, REM, and iron. A microstructure thereof has a main phase of ferrite of at least 40 area %, and a second phase of a low-temperature transformation phase consisting either or both of martensite and bainite, which comprises at least 10 area % in total and retained austenite (γ) at least comprising 3 area % . An average grain diameter of ferrite has a tilt angle of at least 15° is at most 5.0 mm, an average grain diameter of the low-temperature transformation-produced phase is at most 2.0 mm, an average grain diameter of lump-like retained γ having an aspect ratio of less than 5 is at most 1.5 mm, and an area fraction of the lump-like retained γ relative to the retained γ is at least 50%.

7 Claims, No Drawings

COLD-ROLLED STEEL SHEET WITH CONTROLLED MICROSTRUCTURE, GRAIN DIAMETERS, AND TEXTURE

TECHNICAL FIELD

The present invention relates to a cold-rolled steel sheet and process for manufacturing the same. Particularly, the present invention relates to a cold-rolled steel sheet having excellent workability in addition to a high strength, and a process for manufacturing the same.

BACKGROUND ART

Conventionally, refining structure has been studied as a method for improving the mechanical properties of cold-rolled steel sheets.

Patent Document 1 indicated below discloses a cold-rolled steel sheet having a structure including a low-temperature transformation phase consisting of one or more of ferrite, martensite, bainite and retained γ (retained austenite), in which the volume fraction of the low-temperature transformation phase being 10 to 50% and an average grain diameter of the low-temperature transformation phase is at most 2 μm.

Patent Document 2 indicates a method in which a cold-rolled steel sheet is manufactured using a hot-rolled steel sheet manufactured by hot rolling followed by cooling in a short length of time after the hot rolling. For example, Patent Document 2 discloses that a hot-rolled steel sheet having a microstructure containing ferrite having a small average grain diameter as a main phase is manufactured by carrying out cooling to at most 720° C. at a cooling rate of at least 400° C./sec within 0.4 seconds after hot rolling and the hot-rolled steel sheet is subjected to usual cold rolling and annealing.

PRIOR ART DOCUMENTS

Patent Document 1: Japanese Patent Laid-Open No. 2008-231480

Patent Document 2: International Publication No. WO2007/015541, pamphlet

SUMMARY OF INVENTION

Patent Document 1 discloses that a cold-rolled steel sheet having a fine structure is obtained. However, in order to refine structure, it is necessary to contain one or more of Ti, Nb and V, which are precipitating elements. If the steel sheet contains a large amount of such precipitating elements, the ductility of the steel sheet is deteriorated, and thus, it becomes difficult to guarantee excellent ductility and thus excellent workability for the cold-rolled steel sheet disclosed in Patent Document 1.

In this regard, according to the method disclosed in Patent Document 2, structure can be refined without containing precipitating elements and thus a cold-rolled steel sheet having excellent ductility can be manufactured. The manufactured cold-rolled steel sheet has a fine structure even after cold rolling and recrystallization because a hot-rolled steel sheet, which is a starting material of the cold-rolled steel sheet, has a fine structure. Thus, austenite manufactured from the hot-rolled steel sheet also becomes fine and therefore a cold-rolled steel sheet having a fine structure can be obtained. However, since the method of the annealing after cold rolling is a usual one, recrystallization occurs in a heating step during the annealing, and after completion of the recrystallization, austenitic transformation occurs with grain boundaries in the structure after the recrystallization as nucleus forming sites. In other words, after most preferred nucleus forming sites for austenitic transformation such as high angle grain boundaries, fine carbide grains and a low temperature transformation phase existing in the hot-rolled steel sheet have disappeared during the heating in the annealing, austenitic transformation occurs. Accordingly, although a cold-rolled steel sheet obtained by the method disclosed in Patent Document 2 has a fine structure, refining austenite grain in an annealing process is restrictedly premised on the structure after recrystallization, and thus, the fine structure cannot be easily obtained after cold rolling and annealing even if the hot-rolled steel sheet has the fine structure. In particular, where annealing is carried out for a single-phase austenite region, it is difficult to utilize the fine structure of the hot-rolled steel sheet fin order to refine the structure after cold rolling and annealing.

An object of the present invention is to provide a cold-rolled steel sheet having excellent ductility and stretch flangeability in addition to a high strength by enabling to effectively refine a structure after cold rolling and annealing even if a large amount of precipitating elements such as Ti and Nb is not added, and a process for manufacturing the same.

The present inventors employed a composite-structure having a main phase of ferrite in order to obtain a structure for providing excellent ductility and stretch flangeability in addition to high strength and a second phase containing a low-temperature transformation phase to guarantee the strength of the steel sheet and retained austenite to obtain effect of increasing a ductility due to transformation induced plasticity.

Furthermore, generally, a decrease in stretch flangeability (hole expanding formability) is concerned for a structure containing a soft phase such as ferrite and a hard phase such as low temperature transformation phase or retained austenite intermixed therein, and thus, investigation is carried out based on the material quality design concept that such decrease in stretch flangeability is minimized by refining ferrite and hard phase and/or controlling retained austenite form.

In order to obtain such structure, the present inventors conceived of the new concept of promoting austenitic transformation before completion of recrystallization in an annealing process after cold rolling, as opposed to the conventional annealing method in which austenitic transformation is promoted after completion of recrystallization, and conducted test.

As a result, the present inventors obtained the following new knowledge.

1) In the conventional annealing method for promoting austenitic transformation after completion of recrystallization, since austenitic transformation occurs with grain boundaries in the structure after the recrystallization as nucleus forming sites, refining austenite grains (prior austenite grains after annealing; hereinafter also referred to as "prior austenite grains") in the annealing process receives a restriction that the refining is premised on performing austenitic transformation from the structure after recrystallization.

On the other hand, in the annealing method for promoting austenitic transformation after completion of recrystallization, since austenitic transformation occurs with grain boundaries in the structure after the recrystallization as nucleus forming sites, refining austenite grains (prior austenite grains after annealing; hereinafter also referred to as "prior austenite grains") in the annealing process receives a restriction that the refining is premised on performing austenitic transformation from the structure after recrystallization.

2) A steel sheet obtained by the annealing method in which austenitic transformation is promoted before completion of recrystallization in an annealing step after cold rolling, a fraction of lump-like retained austenite having an aspect ratio of less than 5 in all the retained austenite increases. This is because by refining prior-austenite grain, a retained austenite existing on the prior-austenite grain boundaries, the packet boundaries and the block boundaries increases and a retained austenite produced among laths of bainite and/or martensite decreases. Such lump-like retained austenite exists in grain boundaries on which stress is easily concentrated when working the steel sheet compared to retained austenite formed among the laths of bainite and/or martensite. Thus, since ductility can effectively be increased due to transformation induced plasticity, ductility of the steel sheet is increased.

In general, stretch flangeability in structures in which a soft phase, such as ferrite, and retained austenite are intermixed, may concernedly decrease. However, as stated above, in the structure of a cold-rolled steel sheet after annealing, since the ferrite, the low-temperature transformation phase and the retained austenite are effectively refined, the decrease in stretch flangeability is prevented. Thus, excellent stretch flangeability can also be guaranteed.

3) As stated above, in the annealing method in which austenitic transformation is promoted before completion of recrystallization in an annealing step after cold rolling, prior-austenite grains are effectively refined because nuclei of austenitic transformation forms from the high angle grain boundaries, fine carbide grains, and the low-temperature transformation phases, which are preferred nucleus forming sites of austenitic transformation, in the hot-rolled steel sheet. Thus, as a process for manufacturing a hot-rolled steel sheet, the production method described in Patent Document 2, which provides a hot-rolled steel sheet containing preferred nucleus forming sites of austenitic transformation in high density, is preferable. Employment of the above annealing method for a hot-rolled steel sheet obtained by the production method described in Patent Document 2 provides further refining austenite grains in the annealing step and further refining the ferrite, the low-temperature transformation phase and the retained austenite of the structure of the cold-rolled steel sheet after the annealing.

The present inventors found that as a result of the above structure refinement, ductility of the cold-rolled steel sheet and the balance between the ductility and the stretch flangeability is significantly improved.

The present invention based on the above new findings provides a cold-rolled steel sheet including a chemical composition consisting in mass % C: 0.06 to 0.3%, Si: 0.4 to 2.5%, Mn: 0.6 to 3.5%, P: at most 0.1%, S: at most 0.05%, Ti: 0 to 0.08%, Nb: 0 to 0.04%, a total content of Ti and Nb: 0 to 0.10%, sol.Al: 0 to 2.0%, Cr: 0 to 1%, Mo: 0 to 0.3%, V: 0 to 0.3%, B: 0 to 0.005%, Ca: 0 to 0.003%, REM: 0 to 0.003% and the a remainder of Fe and impurities; a microstructure having a main phase of at least 40 area % ferrite, and a second phase of a low-temperature transformation phase consisting of either or both of martensite and bainite at least 10 area % in total and retained austenite at least 3 area %, the microstructure satisfying Equations (1) to (4):

$$d_F \leq 5.0 \quad (1);$$

$$d_{M+B} \leq 2.0 \quad (2);$$

$$d_{As} \leq 1.5 \quad (3); \text{ and}$$

$$r_{As} \geq 50 \quad (4),$$

where $d_F$ is an average grain diameter (μm) of ferrite defined by high angle grain boundaries having a tilt angle of at least 15°;

$d_{M+B}$ is an average grain diameter (μm) of the low-temperature transformation phase;

$d_{As}$ is an average grain diameter (m) of retained austenite having an aspect ratio of less than 5; and $r_{As}$ is an area fraction (%) of retained austenite having an aspect ratio of less than 5 relative to all the retained austenite.

A main phase in the microstructure means a phase having a largest area fraction, and the second phase means any of phases and structures other than the main phase. Each of the average grain diameters means an average Heywood diameter value obtained according to Equation (6), which will be described later, using SEM-EBSD.

It is preferable that the cold-rolled steel sheet according to the present invention further include one or more features of (1) to (7) below.

(1) The cold-rolled steel sheet has a texture in which ratio of an average X-ray intensity for the {100}<011> to {211}<011> orientations relative to the average X-ray intensity of a random structure which does not have a texture at a depth of ½ of the sheet thickness is less than 6.

(2) The chemical composition contains one or two selected from, in mass %, Ti: 0.005 to 0.08% and Nb: 0.003 to 0.04%.

(3) The chemical composition contains, in mass %, sol.Al: 0.1 to 2.0%.

(4) The chemical composition contains one or more selected from, in mass %, Cr: 0.03 to 1%, Mo: 0.01 to 0.3% and V: 0.01 to 0.3%.

(5) The chemical composition contains, in mass %, B: 0.0003 to 0.005%.

(6) The chemical composition contains one or two selected from, in mass %, Ca: 0.0005 to 0.003% and REM: 0.0005 to 0.003%.

(7) The cold-rolled steel sheet has a plating layer on the surface.

Another aspect of the present invention provides a process for manufacturing the above-described cold-rolled steel sheet characterized by comprising the following steps (A) and (B):

(A) a cold rolling step in which a hot-rolled steel sheet having the above chemical composition is subjected to cold rolling to obtain a cold-rolled steel sheet; and (B) an annealing step in which the cold-rolled steel sheet obtained in Step (A) is subjected to heat treatment under conditions that the cold-rolled steel sheet is heated at an average heating rate of at least 15° C./sec so that the proportion of unrecrystallization relative to a region not transformed to austenite when the temperature ($Ac_1$ point+10° C.) is reached is at least 30 area %, and is then held in a temperature range of at least ($0.9 \times Ac_1$ point+$0.1 \times Ac_3$ point) and at most ($Ac_3$ point+100° C.) for 30 seconds.

Here, the $Ac_3$ point and the $Ac_3$ point are transformation points determined from a thermal expansion chart measured when the temperature of the steel sheet is heated at a heating rate of 2° C./sec.

It is preferable that the process for manufacturing the cold-rolled steel sheet according to the present invention provides one or more of following features (8) to (12).

(8) The hot-rolled steel sheet is obtained from coiling at a temperature of at most 300° C. after completion of hot rolling and subsequent heat treatment in a temperature range of 500° C. to 700° C.

(9) The hot-rolled steel sheet is a steel sheet whose average grain diameter of a BCC phase defined by high angle grain boundaries having a tilt angle of at least 15° is at most 6 μm, the steel sheet being obtained by a hot rolling step of cooling at a cooling rate (Crate) satisfying Equation (5) below for a temperature range from the completion of rolling to (temperature at the completion of rolling −100° C.) after completion of hot rolling in which hot rolling is completed at least an $Ar_3$ point.

$$IC(T) = 0.1 - 3\times10^{-3}\cdot T + 4\times10^{-5}\cdot T^2 - 5\times10^{-7}\cdot T^3 + 5\times10^{-9}\cdot T^4 - 7\times10^{-11}\cdot T^5 \int_0^{-100} \frac{-dT}{\mathrm{Crate}(T)\cdot IC(T)} < 4 \quad (5)$$

In the above Equation, Crate (T) is a cooling rate (° C./s) (positive value),

T is a relative temperature with the temperature at the completion of rolling as zero (° C., negative value), and if a temperature at which Crate is zero exists, a value obtained by dividing a holding time (Δt) at the temperature by IC (T) is added as an integral for the section.

(10) The cooling for the temperature range in above (9) includes starting cooling at a cooling rate of at least 400° C./sec and cooling at the cooling rate for a temperature range of at least 30° C.

(11) The cooling for the temperature range in above (9) includes starting water cooling at a cooling rate of at least 400° C./sec and cooling at the cooling rate for a temperature range of at least 30° C. and at most 80° C., and then stopping a water cooling for 0.2 to 1.5 seconds to measure a shape of the sheet during the stopping water cooling, and subsequently cooling at a rate of at least 50° C./sec.

(12) The process for manufacturing the cold-rolled steel sheet further has the step of plating the cold-rolled steel sheet after the Step (B).

The present invention provides effectively refining a structure after cold rolling and annealing without addition of a large amount of elements which precipitate such as Ti and Nb, and thus provides a high-strength cold-rolled steel sheet having excellent ductility and stretch flangeability and a process for manufacturing the same. Since the structure refinement mechanism which is different from that of the conventional method, a fine structure can effectively be obtained even for performing annealing of a single-phase austenite region and a fine structure can be obtained even if a holding time for annealing is made long enough to obtain a stable material.

DESCRIPTION OF EMBODIMENT

The cold-rolled steel sheet according to the present invention and the process for manufacturing the same will be described below. In the below description, each of "%"s in chemical compositions is "mass %" unless particularly notified. Also, each of average grain diameters in the present invention means an average Heywood diameter value obtained according to Equation (5), which will be described later, using SEM-EBSD.

1. Cold-Rolled Steel Sheet 1-1: Chemical Composition

[C: 0.06 to 0.3%]

C has the effect of enhancing the strength of steel. Also when C is concentrated in austenite, C has the effect of obtaining the stable austenite, increasing the fraction of retained austenite in the cold-rolled steel sheet and thereby increasing the ductility of steel. Furthermore, in the annealing step, a temperature range of at least ($Ac_1$ point+10° C.) can easily be reached while maintaining a state with the high percentage of an unrecrystallization by rapid heating, due to the effect of C by which recrystallization of ferrite is suppressed in the course of temperature increase, and the microstructure of the resulting cold-rolled steel sheet is refined. Furthermore, since C has the effect of lowering an $A_3$ point, in the hot rolling process, hot rolling can be completed in a lower-temperature range to easily refine the microstructure of the hot-rolled steel sheet.

If the C content is less than 0.06%, it is difficult to obtain the above-described effects. Accordingly, the C content is made at least 0.06%. It is preferably at least 0.08% and more preferably at least 0.10%. If the C content exceeds 0.3%, there is a marked decrease in workability and weldability. Accordingly, the C content is made at most 0.3%. Preferably it is at most 0.25%.

[Si: 0.4 to 2.5%]

Si has the effect of promoting formation of low-temperature transformation phases such as martensite and bainite, and thereby increasing the strength of the steel. Si also has the effect of promoting formation of retained austenite and thereby increasing the ductility of the steel. If the Si content is less than 0.4%, it is difficult to obtain the above-described effects. Therefore, the Si content is at least 0.4%, preferably at least 0.6%, further preferably at least 0.8%, particularly preferably at least 1.0%. On the other hand, if the Si content exceeds 2.5%, a substantial ductility decrease may occur or platability may be deteriorated. Accordingly, the Si content is at most 2.5%, preferably at most 2.0%.

[Mn: 0.6 to 3.5%]

Mn has the effect of increasing the strength of steel. Mn also has the effect of decreasing a transformation temperature. As a result, during an annealing step, it is facilitated to reach a temperature range of at least ($Ac_1$ point+10° C.) by rapid heating while maintaining a state with a high percentage of unrecrystallized ferrite, and it becomes possible to refine the microstructure of a cold-rolled steel sheet. If the Mn content is less than 0.6%, it becomes difficult to obtain the above-described effects. Therefore, the Mn content is at least 0.6%. On the other hand, if the Mn content exceeds 3.5%, the strength of the steel is excessively increased, which may result in substantial ductility loss. Therefore, the Mn content is at most 3.5%.

[P: At Most 0.1%]

P, which is contained as an impurity, has the action of embrittling the material by segregation at grain boundaries. If the P content exceeds 0.1%, the embrittlement due to the above action may become marked. Therefore, the P content is at most 0.1%, preferably, at most 0.06%. Since the P content is preferably as low as possible, there is no need to provide a lower limit; however, from the standpoint of cost, the P content is preferably at least 0.001%.

[S: At Most 0.05%]

S, which is contained as an impurity, has the action of lowering the ductility of steel by forming sulfide-type inclusions in steel. If the S content exceeds 0.05%, there may be a marked decrease in ductility due to the above-described action. Therefore, the S content is made at most 0.05%, preferably at most 0.008%, further preferably at most 0.003%. Since the S content is preferably as low as possible, there is no need to provide a lower limit; however, from the standpoint of cost, the S content is preferably at least 0.001%.

[Ti: 0 to 0.08%, Nb: 0 to 0.04% and a Total of Ti and Nb: 0 to 0.10%]

Ti and Nb each have the effect of precipitating in steel as carbides or nitrides and suppressing austenite grain growth in the annealing step, thereby promoting refining the structure of the steel. Therefore, the chemical composition of the steel may contain either or both of these elements. However, if the content of each element exceeds the above upper limit or the total content exceeds the above upper limit, the above-described effect is saturated, which results in a disadvantage in costs. Therefore, the content of each element and the total content are set as above. The Ti content is preferably at most 0.05%, further preferably at most 0.03%. The Nb content is preferably at most 0.02%. Also, the total content of Nb and Ti is preferably at most 0.05%, further preferably at most 0.03%. In order to obtain the above-described effect of these elements with greater certainty, it is preferably to satisfy either of the conditions of Ti: at least 0.005% and Nb: at least 0.003%.

[Sol.Al: 0 to 2.0%]

Al has the effect of increasing the ductility of steel. Accordingly, Al may be contained. However, since Al has the effect of increasing an $Ar_3$ transformation point, if the sol.Al content exceeds 2.0%, it becomes necessary to complete hot rolling in a higher temperature range. As a result, it becomes difficult to refine the structure of a hot-rolled steel sheet and it therefore becomes difficult to refine the structure of a cold-rolled steel sheet. In addition, continuous casting sometimes becomes difficult. Accordingly, the sol.Al content is made at most 2.0%. In order to obtain the above-described effect of Al with greater certainty, sol.Al content is preferably at least 0.1%.

[Cr: 0 to 1%, Mo: 0 to 0.3% and V: 0 to 0.3%]

Cr, Mo and V each have the effect of increasing the strength of steel. Also, Mo has the effect of suppressing the growth of grains and refining the structure, and V has the effect of promoting transformation to ferrite and increasing the ductility of the steel sheet. Therefore, one or more of Cr, Mo and V may be contained.

However, if the Cr content exceeds 1%, the ferrite transformation may excessively be suppressed, and as a result, it is impossible to ensure a desired structure. Also, if the Mo content exceeds 0.3% or if the V content exceeds 0.3%, an amount of precipitates may increase in the heating step in the hot rolling process, which can substantially decrease the ductility. Accordingly, the contents of the respective elements are set as above. The Mo content is preferably at most 0.25%. Also, in order to obtain the above effects with greater certainty, it is preferable to satisfy any of the conditions of at least 0.03% Cr, at least 0.01% Mo and at least 0.01% V.

[B: 0 to 0.005%]

B has the effect of increasing the hardenability of steel and promoting the formation of low-temperature transformation phases, thereby increasing the strength of the steel. Therefore, B may be contained. However, if the B content exceeds 0.005%, the steel may excessively hardens, which can result in a significant ductility decrease. Therefore, the B content is at most 0.005%. In order to obtain the above effects with greater certainty, the B content is preferably at least 0.0003%.

[Ca: 0 to 0.003% and REM: 0 to 0.003%]

Ca and REM each have the effect of refining oxides and nitrides precipitated during solidification of molten steel and thereby increasing the soundness of a slab. Therefore, one or more of these elements may be contained. However, each of these elements is expensive, and thus, the content of each element is made at most 0.003%. The total content of these elements is preferably at most 0.005%. In order to obtain the above-described effects with greater certainty, at least 0.0005% Ca or REM is preferably contained.

Here, REM includes a total of 17 elements including, Sc, Y and lanthanoids, and industrially, lanthanoids are generally added in the form of misch metal. The content of REM in the present invention refers to a total content of these elements.

The remainder other than the above is Fe and impurities.

1-2: Microstructure and Texture

[Main Phase]

A main phase includes at least 40 area % ferrite and satisfies Equation (1) above.

Employment of soft ferrite for the main phase can increase the ductility of the cold-rolled steel sheet. Furthermore, an average grain diameter $d_F$ of ferrite defined by high angle grain boundaries having a tilt angle of at least 15° satisfies Equation (1), whereby a hard second phase finely disperses on the grain boundaries of the ferrite, and the formation of fine cracks at the time of working of the steel sheet is suppressed. Also, concentration of stress on the edges of the fine cracks is reduced by refining ferrite, which can suppress the development of the cracks. As a result, the stretch flangeability of the cold-rolled steel sheet is increased.

If the area fraction of the ferrite is less than 40%, it is difficult to guarantee excellent ductility. Therefore, the area fraction of the ferrite is at least 40%. The area fraction of the ferrite is preferably at least 50%.

If the average grain diameter $d_F$ of ferrite defined by the high angle grain boundaries having a tilt angle of at least 15° does not satisfy above Equation (1), the second phase does not uniformly disperse, and thus it is difficult to guarantee excellent stretch flangeability. Therefore, the average grain diameter $d_F$ of the ferrite is set to satisfy above Equation (1). The value of $d_F$ preferably satisfies following Equation (1a).

$$d_F \leq 4.0 \quad (1a)$$

The average grain diameter $d_F$ of ferrite surrounded by the high angle grain boundaries having a tilt angle of at least 15° is used as an index because small angle grain boundaries having a tilt angle of less than 15° are low-energy interfaces having a small difference in orientation between adjoining grains, as a result, it becomes difficult that the second phase precipitates, the effect of finely dispersing the second phase decreases, and contribution to stretch flangeability increasing becomes little.

Hereinafter, the average grain diameter of ferrite defined by the high angle grain boundaries having a tilt angle of at least 15° is simply referred to as the average grain diameter of ferrite. In the present invention, the average grain diameter of ferrite is at most 5.0 μm, preferably at most 4.0 μm.

[Second Phase]

The second phase contains a low-temperature transformation phase consisting of either or both of martensite and bainite at least 10 area % in total and retained austenite at least 3 area %, and satisfies above Equations (2) to (4).

Containing a hard phase or structure formed by low-temperature transformation, such as martensite and/or bainite in the second, which can increase strength of the steel. Also, since retained austenite has the effect of increasing the ductility of the steel sheet, increasing area fraction of retained austenite can guarantee excellent ductility. Furthermore, as a result of the low-temperature transformation phase and the retained austenite being fine enough to satisfy above Equations (2) and (3), the formation and development of fine cracks is suppressed when working the steel sheet and the stretch flangeability of the steel sheet is increased. Furthermore, since lump-like retained austenite having an aspect ratio of less than 5 often exists on the grain boundaries, stress concentration during working can effectively be reduced. Accordingly, by satisfying Equation (4), ductility (in particular, uniform elongation) of the steel sheet can significantly be increased.

If the total area fraction of the low-temperature transformation phase consisting of either or both of martensite and bainite is less than 10%, it is difficult to guarantee high strength. Therefore, the total area fraction of the low-temperature transformation phase is set at least 10%. The low-temperature transformation phase does not need to contain both of martensite and bainite, and may contain only either of them. Also bainite includes bainitic ferrite.

Also, if an average grain diameter $d_{M+B}$ of the low-temperature transformation phase (martensite and/or bainite) does not satisfy above Equation (2), it is difficult to suppress the formation and development of fine cracks during stretch flanging, and thus it is difficult to guarantee excellent stretch flangeability. Therefore, the average grain diameter $d_{M+B}$ of the low-temperature transformation phase needs to satisfy above Equation (2). The value of $d_{M+B}$ preferably satisfies following Equation (2a):

$$d_{M+B} \leq 1.6 \quad (2a)$$

If the area fraction of the retained austenite is less than 3%, it is difficult to guarantee excellent ductility. Therefore, the area fraction of the retained austenite is at least 3%, preferably at least 5%.

If an average grain diameter $d_{As}$ of lump-like retained austenite having an aspect ratio of less than 5 does not satisfy above Equation (3), coarse lump-like martensite is formed by transformation of the retained austenite at the time of working of the steel sheet, and as a result, stretch flangeability of the steel decreases. Therefore, the average grain diameter $d_{As}$ of retained austenite having an aspect ratio of less than 5 needs to satisfy above Equation (3). The value of $d_{As}$ preferably satisfies above Equation (3a).

$$d_{As} \leq 1.0 \quad (3a)$$

If an area fraction $r_{As}$ of the retained austenite having an aspect ratio of less than 5 relative to all the retained austenite does not satisfy Equation (4), ductility hardly increases. Therefore, the area fraction $r_{As}$ of the retained austenite having an aspect ratio of less than 5 relative to all the retained austenite needs to satisfy Equation (4). The value of $r_{As}$ preferably satisfies following Equation (4a).

$$r_{As} \geq 60 \quad (4a)$$

By satisfying Equations (3) and (4), it is possible to exhibit effect of increasing ductility to the maximum extent and suppress decreasing the stretch flangeability (hole expansibility) to the minimum extent.

Here, if the second phase may be contaminated by pearlite and/or cementite, a total area fraction of them should be at most 10%.

The average grain diameter $D_F$ of ferrite is determined by obtaining an average grain diameter of ferrite surrounded by high angle grain boundaries having a tilt angle of at least 15° using SEM-EBSD. SEM-EB SD refers to a method for measuring an orientation of a minute region by electron backscatter diffraction (EBSD) in a scanning electronic microscope (SEM). An obtained orientation map is analyzed to calculate an average grain diameter. The average grain diameters of the low-temperature transformation phase and the retained austenite having an aspect ratio of less than 5 can be calculated by a method similar to the above.

Further, the area fractions of the ferrite and the low-temperature transformation phase are also measured using SEM-EB SD. For the area fraction of the retained austenite, the volume fraction of the austenite obtained by X-ray diffractometry is used as the area fraction as it is.

In the present invention, for each of the average grain diameters and the area fractions above, a value of measurement at a depth of ¼ of a sheet thickness of the steel sheet is employed.

[Texture]

The cold-rolled steel sheet according to the present invention preferably has a texture where ratio of an average of X-ray intensities for {100}<011> to {211}<011> orientations relative to an average of X-ray intensities of a random structure not having texture is less than 6 at a depth of ½ of the sheet thickness.

If growth of a texture of {100}<011> to {211}<011> orientations is suppressed, the workability of the steel is increased. Thus, by reducing an X-ray intensity ratio of the orientations, the workability of the steel is increased. The ratio of an average X-ray intensity of the orientations relative to an average X-ray intensity of random structure not having texture is set to less than 6, and ductility and stretch flangeability can further increase. Therefore, the ratio of the average X-ray intensity of the orientations relative to the average X-ray intensity of the random structure not having texture is preferably less than 6. The ratio is more preferably less than 5, most preferably less than 4. Here, {hkl}<uvw> of a texture represents an crystal orientation in which vertical direction of the sheet and the normal to {hkl} are parallel to each other and a rolling direction and <uvw> are parallel to each other.

The X-ray intensity of the particular orientation can be obtained by chemically polishing the steel sheet to the depth of ½ of the sheet thickness using hydrofluoric acid and subsequently measuring pole figures of the {200}, {110} and {211} planes of the ferrite phase on the sheet and analyzing an orientation distribution function (ODF) by series expansion method using the measurement values.

The X-ray intensities of the random structure not having texture are determined by carrying out measurement similar to the described above using a powdered sample of the steel.

1-3: Plating Layer

With the object of improving corrosion resistance and the like, a plating layer may be provided on the surface of the above-described cold-rolled steel sheet to obtain a surface treated steel sheet. The plating layer may be an electroplated layer or a hot-dip plating layer. Examples of an electroplating are electrogalvanizing and Zn—Ni alloy electroplating. Examples of a hot-dip plating are hot-dip galvanizing, galvannealing, hot-dip aluminum plating, hot-dip Zn—Al alloy plating, hot-dip Zn—Al—Mg alloy plating, and hot-dip Zn—Al—Mg—Si alloy plating. The plating weight is not limited, and it may be a usual value. It is also possible to form a suitable chemical conversion treatment coating on the plating surface (such as one formed by applying a silicate-based chromium-free chemical conversion solution followed by drying) to further improve corrosion resistance. It is also possible to cover the plating with an organic resin coating.

2. Process for Manufacturing 2-1: Hot Rolling and Cooling after Rolling

In the present invention, the structure of the cold-rolled steel sheet is refined by the later-described annealing, and thus, for a hot-rolled steel sheet provided for cold rolling may be carried out in a conventional manner. However, in order to further refine the structure of the cold-rolled steel sheet, it is preferable to refine the structure of a hot-rolled steel sheet provided for cold rolling to increase nucleus forming sites for austenitic transformation. More specifically, this means refining grains surrounded by high angle grain boundaries having a tilt angle of at least 15° and refined dispersion of the second phase such as cementite and/or martensite.

When a hot-rolled steel sheet having a fine structure is subjected to cold rolling and then to annealing by rapid heating, nucleus forming site disappearance due to recrystallization in a heating process can be suppressed by the rapid heating, and thus, the number of nuclei formed in austenite and recrystallized ferrite increases, it is facilitated to refine the final structure.

In the present invention, a hot-rolled steel sheet that is preferable for a starting material for a cold-rolled steel sheet is specifically has an average grain diameter of the BCC phase defined by high angle grain boundaries having a tilt angle of at least 15°, namely at most 6 μm. The average grain diameter of the BCC phase is further preferably at most 5 μm. This average grain diameter can also be obtained by SEM-EBSD.

If the average grain diameter of the BCC phase in the hot-rolled steel sheet is at most 6 μm, the cold-rolled steel sheet can further be refined to further improve mechanical property. Here, since the average grain diameter of the BCC phase in the hot-rolled steel sheet is preferably as small as possible, a lower limit is not recited, but the average grain diameter is normally at least 1.0 μm. The BCC phase mentioned here may include ferrite, bainite and martensite, and consists of one or more of ferrite, bainite and martensite. Martensite is precisely not a BCC phase, but is included in a BCC phase in the Description considering that the aforementioned average grain diameter is obtained by a SEM-EBSD analysis.

Such a hot-rolled steel sheet having a fine structure can be manufactured by carrying out hot rolling and cooling by the method described below.

A slab having the above-described chemical composition is manufactured by continuous casting, and is provided for hot rolling. Here, the slab can be used with a high temperature during the continuous casting or may be first cooled to room temperature and then reheated.

The temperature of the slab which is subjected to hot rolling is preferably at least 1000° C. If the heating temperature of the slab is lower than 1000° C., excessive load is imposed on a rolling mill, and further, the temperature of the steel may decrease to a ferrite transformation temperature during rolling, whereby the steel can be rolled in a state in which transformed ferrite contained in the structure. Therefore, the temperature of the slab is preferably sufficiently high so that hot rolling can be completed in the austenite temperature range.

The hot rolling is preferably carried out using a reverse mill or a tandem mill. From t the standpoint of industrial productivity, it is preferable to use a tandem mill for at least the final number of stands. Since it is necessary to maintain the steel sheet in the austenite temperature range during rolling, the temperature at the completion of the rolling is preferably made at least the $Ar_3$ point.

Rolling reduction in hot rolling is preferably such that the percent reduction in the sheet thickness when the slab temperature is in the temperature range from the $Ar_3$ point to ($Ar_3$ point+150° C.) is at least 40%. The percent reduction in thickness is more preferably at least 60%. It is not necessary to carry out rolling in one pass, and rolling may be carried out by a plurality of sequential passes. Increasing the rolling reduction is preferable because it can introduce a larger amount of strain energy into austenite, thereby increasing the driving force for transformation to BCC phase and refining BCC phase more greatly. However, doing so increases the load on rolling equipment, so the upper limit on the rolling reduction per pass is preferably 60%.

Cooling after the completion of the rolling is preferably carried out by the method described in detail below.

Cooling from the temperature at the completion of rolling is preferably carried out at a cooling rate (Crate) satisfying Equation (4) below in a temperature range from the temperature at the completion of rolling to (temperature at the completion of rolling −100° C.).

$$IC(T) = 0.1 - 3\times10^{-3}\cdot T + 4\times10^{-5}\cdot T^2 - 5\times10^{-7}\cdot T^3 + 5\times10^{-9}\cdot T^4 - 7\times10^{-11}\cdot T^5 \int_0^{-100} \frac{-dT}{\mathrm{Crate}(T)\cdot IC(T)} < 4 \quad (5)$$

Equation (5) above indicates a condition to be cooled to an austenite unrecrystallization temperature range (temperature at the completion of rolling −100° C.) before strain energy accumulated in the steel sheet during hot rolling is consumed by recovery and recrystallization after completion of the hot rolling. More specifically, IC (T) is a value that can be obtained by calculation of body diffusion of Fe atoms, and represents a period of time from completion of hot rolling to a start of recovery of austenite. Furthermore, (1/(Crate(T)·IC(T))) is a value of a period of time required for cooling by 1° C. at a cooling rate (Crate(T)), the period of time being normalized by IC(T), that is, represents a fraction of cooling time relative to a period of time until disappearance of strain energy by recovery and recrystallization. Therefore, a value that can be obtained by integrating (1/Crate(T)·IC(T)) in a range of T=0 to −100° C. serves as an index representing an amount of strain energy disappeared during cooling. By limiting the value, cooling conditions (cooling rate and holding time) required for cooling by 100° C. before disappearance of a certain amount of strain energy. The value of the right side of Equation (5) is preferably 3.0, more preferably 2.0, further preferably 1.0.

In a preferred cooling method satisfying above Equation (5), primary cooling is preferably started from the temperature at the completion of rolling at a cooling rate of at least 400° C./sec and is preferably carried out in a temperature range of at least 30° C. at this cooling rate. The temperature range is preferably at least 60° C. If water cooling stop time which will be described later is not set, the temperature range is further preferably at least 100° C. The cooling rate for the primary cooling is more preferably at least 600° C./sec, particularly preferably at least 800° C./sec. The primary cooling can be started after holding at the temperature at the completion of rolling for a short length of time of at most 5 seconds. The time from completion of the rolling to start of the primary cooling is preferably less than 0.4 seconds so as to satisfy above Equation (5).

Also, preferably, water cooling is started at a cooling rate of at least 400° C./sec immediately after the rolling completion, and cooling is carried at this cooling rate for a temperature range of at least 30° C. and at most 80° C., and then a water cooling stop time of 0.2 to 1.5 seconds (preferably at most 1 second) is set, and during that time, the sheet shape such as the sheet thickness or sheet width are measured, and then cooling (secondary cooling) is carried out at a rate of at least 50° C./sec. Since feedback of the sheet shape can be controlled by such sheet shape measurement, the productivity is improved. The water cooling stop time is preferably at most 1 second. During the water cooling stop time, the sheet may be subjected to natural cooling or air cooling.

Industrially, the primary cooling and secondary cooling above are carried out by water cooling.

When the cooling conditions for cooling from the temperature at the completion of rolling to the temperature of (temperature at the completion of rolling −100° C.) satisfy above Equation (5), the consumption of the strain by recovery and recrystallization introduced to austenite as a result of the hot rolling, can be suppressed as much as possible, as a result, the strain energy accumulated in the steel can be used as a driving force for transformation from austenite to the BCC phase to a maximum extent. A reason to make the cooling rate of the primary cooling from the temperature at the completion of rolling at least 400° C./sec is also the same as above, which is an increase in the transformation driving force. Consequently, an amount of formed nuclei for transformation from austenite to the BCC phase increases, thereby refining the structure of the hot-rolled steel sheet. By using a hot-rolled steel sheet having a fine structure manufactured as described above for a starting material, the structure of the cold-rolled steel sheet can further be refined.

After the primary cooling, or the primary cooling and the secondary cooling have been carried out as described above, structure control such as ferrite transformation or precipitation of fine grains consisting of Nb and/or Ti may be carried out by holding the temperature of the steel sheet in an desired temperature range for an desired length of time before cooled to a coiling temperature. The "holding" mentioned here includes natural cooling and retaining heat. Considering the temperature and the holding time suitable for the structure control, for example, natural cooling is carried out in a temperature range of 600° C. to 680° C. for around 3 to 15 seconds, which can introduce fine ferrite to the hot-rolled sheet structure.

Subsequently, the steel sheet is cooled to the coiling temperature. For a cooling method in this step, cooling can be carried out at a desired cooling rate by a method selected from water cooling, mist cooling and gas cooling (including air cooling). The coiling temperature for the steel sheet is preferably at most 650° C. from the standpoint of refining the structure with greater certainty.

The hot-rolled steel sheet manufactured by the above heat-rolling process has a structure in which a sufficiently large number of high angle grain boundaries has been introduced, an average grain diameter of grains defined by high angle grain boundaries having a tilt angle of at least 15° is at most 6 μm and second phases such as martensite and/or cementite are finely dispersed. As described above, it is favorable that the hot-rolled steel sheet in which a large number of high angle grain boundaries exists and the second phases are finely dispersed, is subjected to cold rolling and annealing. This is because since these high angle grain boundaries and fine second phases are preferred nucleus forming sites for austenitic transformation, the structure can be refined by producing a large number of austenite and recrystallized ferrite from these positions by rapid heating annealing.

The structure of the hot-rolled steel sheet can be a ferrite structure containing pearlite as a second phase, a structure consisting of bainite and martensite, or a structure of a mixture thereof.

2-2: Heat Treatment of Hot-Rolled Steel Sheet

The above hot-rolled steel sheet may be subjected to annealing at a temperature of 500° C. to 700° C. The annealing is particularly suitable for a hot-rolled steel sheet coiled at a temperature of at most 300° C.

The annealing can be carried out by a method in which a heat-rolled coil is made to pass through a continuous annealing line or a method in which the coil is put as it is in a batch annealing furnace. In heating the hot-rolled steel sheet, a heating rate up to an annealing temperature of 500° C. can be a desirable rate in a range from slow heating of around 10° C./hour to rapid heating of 30° C./sec.

Annealing temperature (soaking temperature) is in a temperature range of 500° C. to 700° C. A holding time in this temperature range does not need to be specifically limited; however, the holding time is preferably at least 3 hours. From the standpoint of suppressing coarsening of carbide, an upper limit of the holding time is preferably at most 15 hours, more preferably at most 10 hours.

As a result of such annealing of the hot-rolled steel sheet, fine carbides can be dispersed in the grain boundaries, the packet boundaries and the block boundaries in the hot-rolled steel sheet, and carbides can further finely be dispersed by a combination of the annealing and the above-described rapid cooling for an extremely short length of time immediately after completion of hot rolling. As a result, austenite nucleus forming sites can be increased during annealing to refine a final structure. The annealing of the hot-rolled steel sheet also has the effect of softening the hot-rolled steel sheet to decrease the load on the cold rolling equipment.

2-3: Pickling and Cold Rolling

The hot-rolled steel sheet manufactured by the method described above is subjected to pickling and then to cold rolling. Each of the pickling and the cold rolling may be carried out in a conventional manner. The cold rolling can be carried out using lubricating oil. The cold rolling ratio does not need to be specifically determined, but is normally at least 20%. If the cold rolling reduction exceeds 85%, load on the cold rolling equipment becomes large, and thus, the cold rolling ratio is preferably at most 85%.

2-4: Annealing

A cold-rolled steel sheet which is obtained by the above-described cold rolling is subjected to annealing by heating at an average heating rate of at least 15° C./sec so that the unrecrystallization ratio of a region not transformed to austenite at a point of time of reaching ($Ac_1$ point+10° C.) is at least 30%.

As described above, by heating up to ($Ac_1$ point+10° C.) in a state in which unrecrystallization structure remains, a large number of fine austenite nuclei to be formed as the high angle grain boundaries and/or the second phases of the hot-rolled steel sheet as nucleus forming sites. Here, the hot-rolled steel sheet preferably has a fine structure because a large number of nuclei can be formed. The increase in the number of austenite nuclei formed enables significantly refining austenite grains during the annealing, enabling refining ferrite, low-temperature transformation phases and retained austenite, which are produced subsequently.

On the other hand, if the unrecrystallization ratio of the region not transformed to austenite at the time of reaching ($Ac_1$ point+10° C.) is less than 30%, in most regions, austenitic transformation have been promoted after completion of recrystallization. As a result, in such regions, austenitic transformation is promoted from the grain boundaries of the recrystallized grains, and thus, the austenite grains during annealing are coarsened and the final structure is also coarsened.

Therefore, the average heating rate is at least 15° C./sec so that the unrecrystallization ratio of the regions not transformed to austenite at the time of reaching ($Ac_1$ point+10° C.) becomes at least 30 area %. The average heating rate is preferably at least 30° C./sec, further preferably at least 80° C./sec, particularly preferably at least 100° C./sec. An upper limit of the average heating rate is not specifically defined, but is preferably at most 1000° C./sec to avoid temperature control difficulty.

The above temperature for starting the rapid heating at a rate of at least 15° C./sec may be any desired temperature if the recrystallization has not started yet, and may be, $T_s$−30° C. relative to a the temperature for the start of softening (the temperature for the start of recrystallization) $T_s$ measured under a heating rate of 10° C./sec. The heating rate in the temperature range before such temperature is reached can arbitrarily be determined. For example, even if rapid heating is started from around 600° C., effect of sufficiently refining grain can be obtained. Also, even if rapid heating is started from room temperature, nit does not have an adverse effect on the cold-rolled steel sheet after annealing.

It is preferable to use electrical heating, resistance heating or induction heating in order to obtain a sufficiently rapid heating rate, but as long as the above-described temperature increase conditions are satisfied, it is also possible to adopt heating by a radiant tube. By using such a heating device, the time for heating a steel sheet is greatly decreased, and it is possible to make annealing equipment more compact, whereby effects such as a decrease in investment in equipment can be expected. It is also possible to add a heating device to an existing continuous annealing line or a hot-dip plating line to carry out the heating.

After heating to ($Ac_1$ point+10° C.), heating is carried out to an annealing temperature in a range of at least ($0.9\times Ac_1$ point+$0.1\times Ac_3$ point) and at most ($Ac_3$ point+100° C.). The heating rate in this temperature range can be any desired rate. Decreasing a heating rate can obtain sufficient time to promote recrystallization of ferrite. Also, the heating rate can be varied in such a manner that rapid heating (for example, at a rate that is the same as that of the above rapid heating) is first carried out at any in the temperature range and subsequently the heating rate is lowered.

In the annealing process, transformation to austenite is sufficiently promoted and carbides are dissolved in the steel. Thus, the annealing temperature is at least ($0.9\times Ac_1+0.1\times Ac_3$ point). The annealing temperature is preferably at least ($0.3\times Ac_1$ point+$0.7\times Ac_3$ point), and in this case, in particular, the texture of the cold-rolled steel sheet, the strength of {100}<011> to {211}<011> orientations is lowered and the workability of the steel sheet is increased. On the other hand, if soaking holding is carried out at a temperature exceeding ($Ac_3$ point+100° C.) as the annealing temperature, sharp growth of austenite grains occur, and as a result, the final structure becomes coarse. Thus, the annealing temperature is at most ($Ac_3$ point+100° C.), preferably at most ($Ac_3$ point+50° C.).

The $Ac_1$ and $Ac_3$ points in the present invention are values that can be determined from a thermal expansion chart measured when the temperature of the steel sheet which was cold rolled is heated to 1100° C. at a heating rate of 2° C./sec.

If an annealing holding time for the temperature range is at most 30 seconds, dissolution of the carbides and transformation to austenite are not sufficiently promoted, resulting in a decrease in workability of the cold-rolled steel sheet. Also, temperature unevenness during the annealing easily occurs, causing a problem in production stability. Therefore, it is necessary to determine an annealing holding time of at least 30 seconds to sufficiently promote transformation to austenite and dissolution of the carbides. An upper limit of the holding time is not specifically determined; however, from the standpoint of suppressing the austenite grain growth, the annealing holding time is preferably less than 10 minutes.

In cooling after annealing, temperature history such as the cooling rate and the temperature and time of low-temperature holding are controlled to form proper area fractions of ferrite, the low-temperature transformation phase and the retained austenite, whereby the structure of the cold-rolled steel sheet is controlled. If the cooling rate in the cooling after annealing is too low, the low-temperature transformation phase is reduced to less than 10 area %, resulting in decrease in strength of the steel sheet. Thus, an average cooling rate for a temperature range of from 650° C. to 500° C. is preferably at least 1° C./sec. On the other hand, if the cooling rate is too high, the area fraction of the low-temperature transformation phase is excessively increased, deteriorating the ductility of the steel sheet. Thus, the average cooling rate for the above temperature range is preferably at most 60° C./sec. The cooling may be performed by an arbitrary method. For example, cooling using gas, mist or water or a combination thereof can be employed.

After the cooling in the temperature range, the cooling is stopped or the cold-rolled steel sheet is held in a low-temperature range for slow cooling, whereby a proper area fraction of the low-temperature transformation phase is formed in the cold-rolled steel sheet, and diffusion of carbon atoms to untransformed austenite is promoted to form retained austenite.

After the annealing, in a cooling process to room temperature, hot-dip plating may be performed to provide a hot-dip plated steel sheet, or hot-dip plating or electroplating may be performed in a separate process after the cooling to room temperature to provide a hot-dip plated steel sheet or an electroplated steel sheet. If hot-dip plating is performed in the cooling process to room temperature to provide a hot-dip plated steel sheet, the steel sheet may be retained at a temperature that is higher or lower than that of a hot-dip plating bath before the hot-dip plating. The hot-dip plating layer, the electroplating layer or the plating adhesion amount have been described above. In order to further improve the corrosion resistance, proper chemical conversion coating may be performed after the plating.

EXAMPLES

Each ingot of steel types A to N each having the chemical composition indicated in Table 1 was melted in a vacuum induction furnace. Table 1 indicates $Ac_1$ and also $Ac_3$ points for each of steel types A to N. These transformation temperatures are obtained from a thermal expansion curve measured when the temperature of the relevant steel sheet subjected to cold rolling under the later-described production conditions is raised to 1100° C. at a heating rate of 2°

C./sec. Table 1 also indicates each value of ($Ac_1$ point+10° C.), (0.9×$Ac_1$ point+0.1×$Ac_3$ point) and ($Ac_3$ point+100° C.).

TABLE 1

| Steel type | Chemical composition (unit: mass %, remainder of Fe and impurities) C | Si | Mn | P | S | Others | $Ac_1$ (° C.) | $Ac_3$ (° C.) | $Ac_1$ + 10 (° C.) | 0.9$Ac_1$ + 0.1$Ac_3$ (° C.) | $Ac_3$ + 100 (° C.) |
|---|---|---|---|---|---|---|---|---|---|---|---|
| A | 0.175 | 1.22 | 2.51 | 0.008 | 0.001 | Nb: 0.010 | 721 | 838 | 731 | 733 | 938 |
| B | 0.179 | 1.23 | 1.92 | 0.010 | 0.002 | Nb: 0.010, Cr: 0.29 | 728 | 858 | 738 | 741 | 958 |
| C | 0.177 | 1.01 | 2.21 | 0.004 | 0.001 | Nb: 0.010, Mo: 0.20 | 723 | 829 | 733 | 734 | 929 |
| D | 0.176 | 1.13 | 2.49 | 0.003 | 0.001 | Nb: 0.011, sol.Al: 0.15 | 721 | 844 | 731 | 733 | 944 |
| E | 0.148 | 1.78 | 2.49 | 0.009 | 0.002 | Ca: 0.0011 | 719 | 863 | 729 | 733 | 963 |
| F | 0.201 | 1.23 | 2.19 | 0.003 | 0.002 | Ti: 0.03 | 713 | 843 | 723 | 726 | 943 |
| G | 0.182 | 1.27 | 1.93 | 0.010 | 0.001 | Nb: 0.011, REM: 0.0010 | 722 | 872 | 732 | 737 | 972 |
| H | 0.235 | 1.26 | 2.82 | 0.010 | 0.001 | | 705 | 832 | 715 | 718 | 932 |
| I | 0.119 | 0.98 | 2.91 | 0.011 | 0.001 | Ti: 0.015, Nb: 0.010, B: 0.0009 | 714 | 831 | 724 | 726 | 931 |
| J | 0.072 | 0.72 | 2.79 | 0.011 | 0.001 | Nb: 0.005, V: 0.20 | 711 | 842 | 721 | 724 | 942 |
| K | 0.181 | 1.03 | 2.23 | 0.011 | 0.001 | Nb: 0.123 | 722 | 849 | 732 | 735 | 949 |
| L | 0.143 | 0.06 | 0.71 | 0.011 | 0.001 | | 712 | 836 | 722 | 724 | 936 |
| M | 0.121 | 0.48 | 1.53 | 0.012 | 0.001 | Nb: 0.029, sol.Al: 0.98 | 723 | 972 | 733 | 748 | 1072 |
| N | 0.118 | 0.51 | 1.52 | 0.011 | 0.001 | sol.Al: 1.03 | 719 | 953 | 729 | 742 | 1053 |

An underline means that the relevant steel type or value fall outside the scope of the invention.

These ingots were hot forged and cut to the shape of slabs to be subjected to hot rolling. These slabs were heated for one hour at a temperature of at least 1000° C., and then subjected to hot rolling in which rolling was completed at the temperature at the completion of rolling (indicated also as FT in Table 2) indicated in Table 2 using a small test mill for trials, whereby a hot-rolled steel sheet having a sheet thickness of 2.0 to 2.6 mm under the cooling conditions and at the coiling temperature that are indicated in the table.

The cooling after the rolling completion was each carrying out by any of the following methods:

1) carrying out only primary cooling for a temperature decrease amount of at least 100° C. immediately after completion of the rolling;
2) carrying out only primary cooling for a temperature decrease amount of at least 100° C. after holding (natural cooling) at temperature at the completion of rolling (FT) for a predetermined period of time; and
3) carrying out primary cooling immediately after completion of the rolling, stopping the primary cooling when the relevant steel sheet was cooled by 30° C. to 80° C. from the temperature at the completion of rolling (FT), and held at the temperature (allowed to naturally cool) for a predetermined length of time, and then carrying outing secondary cooling.

The steel sheet was naturally cooled for 3 to 15 seconds after stoppage of primary cooling if primary cooling was carried out alone, and after stoppage of secondary cooling if secondary cooling was carried out, and subsequently was water cooled at a cooling rate of 30° C. to 100° C./sec to the coiling temperature. Subsequently, the steel sheet was put in a furnace and subjected to slow cooling simulated for coiling. A value of the left side of Equation (5) and an average grain diameter of a BCC phase of the hot-rolled steel sheet are also indicated in Table 2.

Measurement of an average grain diameter of a BCC phase in the hot-rolled steel sheet was carried out by analyzing grain diameters of the BCC phase defined by high angle grain boundaries having a tilt angle of at least 15° in a cross-section of the structure of the steel sheet, the cross-section being parallel to a rolling direction and the sheet thickness direction of the steel sheet, using an SEM-EB SD apparatus (JSM-7001F manufactured by JEOL Ltd.). The average grain diameter d of the BCC phase was obtained using following Equation (6). Here, Ai represents the area of an i-th grain, and di represents a Heywood diameter of the i-th grain.

$$d = \frac{\sum_i Ai \times di}{\sum_i Ai} \tag{6}$$

For some of the hot-rolled steel sheets, hot-rolled plate annealing was carried out under the conditions indicated in Table 2 using a heating furnace.

Each of the hot-rolled steel sheets obtained as described above was subjected to pickling using a hydrochloric acid and cold rolling at the rolling reduction indicated in Table 2 in a conventional manner to make the steel sheet have a thickness of 1.0 to 1.2 mm. Subsequently, using a laboratory scale annealing equipment, annealing was carried out at the heating rate, the annealing temperature and the holding time indicated in Table 2, and cooling was carried out under a condition that makes the cooling rate for a temperature range of from 650° C. to 500° C. become the "Cooling rate" indicated in Table 2, whereby the resulting cold-rolled steel sheet was obtained. Furthermore, in a cooling process, as indicated in Table 2, each steel sheet was subjected to any of heat treatments indicated in A to I below, and then cooled to room temperature at 2° C./sec, whereby the resulting cold-rolled steel sheet was obtained. Cooling after the soaking was carried out using a nitrogen gas. Underlined values in Tables 2 and 3 indicate values outside the range of the present invention.

A: Holding at 375° C. for 330 seconds
B: Holding at 400° C. for 330 seconds
C: Holding at 425° C. for 330 seconds
D: Holding at 480° C. for 15 seconds, then cooling to 460° C. for simulation of hot-dip galvanizing bath immersion, and further heating to 500° C. for simulation of alloying
E: Holding at 480° C. for 60 seconds, then cooling to 460° C. for simulation of hot-dip galvanizing bath immersion, and further heating to 520° C. for simulation of alloying
F: Holding at 480° C. for 60 seconds, then cooling to 460° C. for simulation of hot-dip galvanizing bath immersion, and further heating to 540° C. for simulation of alloying.

G: Holding at 375° C. for 60 seconds, then cooling to 460° C. for simulation of hot-dip galvanizing bath immersion, and further heating to 500° C. for simulation of alloying.

H: Holding at 400° C. for 60 seconds, then cooling to 460° C. for simulation of hot-dip galvanizing bath immersion, and further heating to 500° C. for simulation of alloying.

I: Holding at 425° C. for 60 seconds, then cooling to 460° C. for simulation of hot-dip galvanizing bath immersion, and further heating to 500° C. for simulation of alloying.

Table 2 indicates a proportion of an unrecrystallization of regions not transformed to austenite at the time of reaching ($Ac_1$ point+10° C.). This value was obtained by the following method. Each steel sheet that has been subjected to cold rolling according to the manufacturing conditions in the present invention was heated to the temperature ($Ac_1$ point+10° C.) at the heating rate indicated in the relevant steel sheet number and then immediately cooled by water cooling. The structure of the steel sheet was photographed using an SEM, and on the structure photograph, the fractions of a recrystallization structure and a deformed structure of each of regions except martensite, that is, regions other than regions transformed to austenite at the time of reaching ($Ac_1$ point+10° C.) were measured to obtain the proportion of the unrecrystallization.

TABLE 2

| Steel | | Hot rolling | | | | | | | | | Hot-rolled |
|---|---|---|---|---|---|---|---|---|---|---|---|
| | | Temperature at completion | Primary | Primary cooling temperature | Secondary cooling | Holding in temperature range of FT to (FT-100° C.) | | Value of left side of | Coiling | Average grain diameter of BCC phase of hot-rolled steel | plate annealing Annealing temperature |
| sheet No. | Steel Type | of rolling ° C. | cooling rate ° C./s | decrease ° C. | rate ° C./s | Temperature ° C. | Time sec | Formula (5) — | temperature ° C. | plate μm | (° C.) ° C. |
| 1 | A | 895 | 1210 | 235 | — | — | — | 0.23 | 500 | 4.9 | — |
| 2 | A | 895 | 1210 | 235 | — | — | — | 0.23 | 500 | 4.9 | — |
| 3 | A | 895 | 1210 | 235 | — | — | — | 0.23 | 500 | 4.9 | — |
| 4 | A | 895 | 1210 | 235 | — | — | — | 0.23 | 500 | 4.9 | — |
| 5 | A | 900 | 870 | 80 | 170 | 820 | 0.75 | 0.54 | 500 | 5.2 | — |
| 6 | A | 900 | 870 | 80 | 170 | 820 | 0.75 | 0.54 | 500 | 5.2 | — |
| 7 | A | 900 | 870 | 80 | 170 | 820 | 0.75 | 0.54 | 500 | 5.2 | — |
| 8 | A | 895 | 200 | 190 | — | 895 | 3.00 | 31.00 | 500 | 9.8 | — |
| 9 | A | 895 | 200 | 190 | — | 895 | 3.00 | 31.00 | 500 | 9.8 | — |
| 10 | A | 895 | 200 | 190 | — | 895 | 3.00 | 31.00 | 600 | 11.2 | — |
| 11 | B | 900 | 920 | 190 | — | — | — | 0.30 | 500 | 5.1 | — |
| 12 | B | 900 | 920 | 190 | — | — | — | 0.30 | 500 | 5.1 | — |
| 13 | B | 900 | 920 | 190 | — | — | — | 0.30 | 500 | 5.1 | — |
| 14 | B | 900 | 180 | 180 | — | 900 | 3.50 | 37.00 | 500 | 10.6 | — |
| 15 | B | 900 | 180 | 180 | — | 900 | 3.50 | 37.00 | 500 | 10.6 | — |
| 16 | B | 900 | 920 | 190 | — | — | — | 0.30 | 150 | 5.1 | 600 |
| 17 | B | 900 | 920 | 190 | — | — | — | 0.30 | 150 | 5.1 | 600 |
| 18 | B | 900 | 920 | 50 | 170 | 850 | 2.00 | 3.30 | 150 | 5.5 | 600 |
| 19 | C | 900 | 1130 | 240 | — | — | — | 0.24 | 500 | 5.0 | — |
| 20 | C | 900 | 1130 | 240 | — | — | — | 0.24 | 500 | 5.0 | — |
| 21 | C | 900 | 1130 | 240 | — | — | — | 0.24 | 500 | 5.0 | — |
| 22 | D | 900 | 1210 | 235 | — | — | — | 0.23 | 500 | 5.0 | — |
| 23 | D | 900 | 1210 | 235 | — | — | — | 0.23 | 500 | 5.0 | — |
| 24 | D | 900 | 1210 | 235 | — | — | — | 0.23 | 500 | 5.0 | — |
| 25 | E | 890 | 880 | 70 | 170 | 820 | 1.00 | 0.82 | 150 | 4.8 | 600 |
| 26 | E | 890 | 880 | 70 | 170 | 820 | 1.00 | 0.82 | 150 | 4.8 | 600 |
| 27 | F | 895 | 1210 | 230 | — | — | — | 0.23 | 500 | 5.1 | — |
| 28 | F | 895 | 1210 | 230 | — | — | — | 0.23 | 500 | 5.1 | — |
| 29 | F | 895 | 1210 | 230 | — | — | — | 0.23 | 500 | 5.1 | — |
| 30 | F | 895 | 1210 | 230 | — | — | — | 0.23 | 500 | 5.1 | — |
| 31 | F | 895 | 1210 | 230 | — | — | — | 0.23 | 500 | 5.1 | — |
| 32 | F | 895 | 1210 | 230 | — | — | — | 0.23 | 150 | 5.3 | 600 |
| 33 | F | 895 | 1210 | 230 | — | — | — | 0.23 | 150 | 5.3 | 600 |
| 34 | G | 900 | 980 | 250 | — | — | — | 0.28 | 400 | 5.6 | — |
| 35 | G | 900 | 980 | 250 | — | — | — | 0.28 | 400 | 5.6 | — |
| 36 | H | 900 | 1210 | 235 | — | — | — | 0.23 | 500 | 4.8 | — |
| 37 | H | 900 | 1210 | 235 | — | — | — | 0.23 | 500 | 4.8 | — |
| 38 | H | 900 | 1210 | 235 | — | — | — | 0.23 | 500 | 4.8 | — |
| 39 | H | 900 | 1210 | 235 | — | — | — | 0.23 | 150 | 5.0 | 600 |
| 40 | 1 | 810 | 840 | 190 | — | — | — | 0.33 | 150 | 2.1 | — |
| 41 | I | 810 | 840 | 190 | — | — | — | 0.33 | 150 | 2.1 | — |
| 42 | J | 820 | 840 | 180 | — | — | — | 0.33 | 150 | 2.1 | — |
| 43 | J | 820 | 840 | 180 | — | — | — | 0.33 | 150 | 2.1 | — |
| 44 | J | 820 | 840 | 180 | — | — | — | 0.33 | 150 | 2.1 | — |
| 45 | K | 900 | 980 | 250 | — | — | — | 0.28 | 500 | 4.5 | — |
| 46 | K | 900 | 980 | 250 | — | — | — | 0.28 | 500 | 4.5 | — |
| 47 | L | 850 | 885 | 200 | — | — | — | 0.31 | 150 | 2.1 | — |
| 48 | L | 850 | 885 | 200 | — | — | — | 0.31 | 150 | 2.1 | — |
| 49 | M | 1000 | 780 | 330 | — | — | — | 0.35 | 400 | 3.1 | — |
| 50 | M | 1000 | 780 | 330 | — | — | — | 0.35 | 400 | 3.1 | — |
| 51 | M | 1000 | 780 | 330 | — | — | — | 0.35 | 400 | 3.1 | — |
| 52 | N | 1000 | 780 | 330 | — | — | — | 0.35 | 400 | 3.8 | — |

TABLE 2-continued

| | | | | | | | | | | | |
|---|---|---|---|---|---|---|---|---|---|---|---|
| 53 | N | 1000 | 780 | 330 | — | — | — | 0.35 | 400 | 3.8 | — |
| 54 | N | 1000 | 780 | 330 | — | — | — | 0.35 | 400 | 3.8 | — |

| Steel sheet No. | Hot-rolled plate Annealing: Time of holding in temperature range of 500° C. to 700° C. hr | Cold rolling Rolling reduction ratio % | Continous annealing: Heating rate ° C./s | Annealing temperature ° C. | Annealing time s | Cooling rate for temperature region of 650° C. to 500° C. ° C./s | Proportion of uncrystallization at $Ac_1$ + 10° C. of region not transformed to austenite at % | Heat treatment symbol | Remarks |
|---|---|---|---|---|---|---|---|---|---|
| 1 | — | 50 | 30 | 850 | 95 | 10 | 85 | I | Example of invention |
| 2 | — | 50 | 200 | 850 | 95 | 10 | 100 | I | Example of invention |
| 3 | — | 50 | 30 | 820 | 95 | 10 | 85 | G | Example of invention |
| 4 | — | 50 | 150 | 950 | 95 | 10 | 100 | I | Comparative example |
| 5 | — | 50 | 2 | 850 | 95 | 10 | 0 | H | Comparative example |
| 6 | — | 50 | 30 | 850 | 95 | 10 | 85 | I | Example of invention |
| 7 | — | 50 | 30 | 830 | 95 | 10 | 85 | H | Example of invention |
| 8 | — | 50 | 2 | 850 | 95 | 10 | 0 | C | Comparative example |
| 9 | — | 50 | 30 | 850 | 95 | 10 | 85 | C | Example of invention |
| 10 | — | 50 | 200 | 830 | 95 | 10 | 100 | B | Example of invention |
| 11 | — | 50 | 2 | 865 | 95 | 10 | 0 | I | Comparative example |
| 12 | — | 50 | 50 | 865 | 95 | 10 | 90 | H | Example of invention |
| 13 | — | 50 | 50 | 845 | 95 | 10 | 90 | I | Example of invention |
| 14 | — | 50 | 2 | 865 | 95 | 10 | 0 | I | Comparative example |
| 15 | — | 50 | 50 | 865 | 95 | 10 | 90 | H | Example of invention |
| 16 | 7 | 50 | 2 | 865 | 95 | 10 | 0 | C | Comparative example |
| 17 | 7 | 50 | 30 | 865 | 95 | 10 | 85 | C | Example of invention |
| 18 | 7 | 50 | 50 | 845 | 95 | 10 | 90 | B | Example of invention |
| 19 | — | 50 | 2 | 850 | 95 | 10 | 0 | E | Comparative example |
| 20 | — | 50 | 150 | 850 | 95 | 10 | 100 | E | Example of invention |
| 21 | — | 50 | 150 | 830 | 95 | 10 | 100 | E | Example of invention |
| 22 | — | 50 | 10 | 850 | 95 | 10 | 15 | E | Comparative example |
| 23 | — | 50 | 30 | 850 | 95 | 10 | 85 | E | Example of invention |
| 24 | — | 50 | 150 | 830 | 95 | 10 | 100 | D | Example of invention |
| 25 | 7 | 50 | 2 | 870 | 95 | 10 | 0 | B | Comparative example |
| 26 | 7 | 50 | 30 | 870 | 95 | 10 | 85 | B | Example of invention |
| 27 | — | 50 | 2 | 850 | 95 | 10 | 0 | A | Comparative example |
| 28 | — | 50 | 30 | 850 | 95 | 10 | 85 | B | Example of invention |
| 29 | — | 50 | 30 | 950 | 95 | 10 | 85 | B | Comparative example |
| 30 | — | 50 | 100 | 830 | 95 | 10 | 100 | B | Example of invention |
| 31 | — | 50 | 30 | 850 | 95 | 10 | 85 | F | Example of invention |
| 32 | 7 | 50 | 10 | 850 | 95 | 10 | 15 | H | Comparative example |
| 33 | 7 | 50 | 30 | 830 | 95 | 10 | 85 | H | Example of invention |
| 34 | — | 50 | 2 | 880 | 95 | 10 | 23 | C | Comparative example |
| 35 | | 50 | 30 | 855 | 95 | 10 | 100 | B | Example of invention |
| 36 | — | 50 | 2 | 850 | 95 | 10 | 0 | H | Comparative example |
| 37 | — | 50 | 30 | 850 | 95 | 10 | 85 | H | Example of invention |
| 38 | — | 50 | 30 | 820 | 95 | 10 | 85 | G | Example of invention |
| 39 | 7 | 50 | 30 | 820 | 200 | 10 | 85 | G | Example of invention |
| 40 | — | 55 | 10 | 820 | 60 | 50 | 23 | B | Comparative example |
| 41 | — | 55 | 100 | 820 | 60 | 50 | 100 | B | Example of invention |
| 42 | — | 55 | 10 | 840 | 60 | 10 | 19 | B | Comparative example |
| 43 | — | 55 | 50 | 840 | 60 | 10 | 55 | B | Example of invention |
| 44 | — | 55 | 100 | 840 | 60 | 10 | 85 | B | Example of invention |
| 45 | — | 50 | 30 | 865 | 95 | 10 | 95 | H | Comparative example |
| 46 | — | 50 | 100 | 865 | 95 | 10 | 100 | H | Comparative example |
| 47 | — | 50 | 10 | 850 | 60 | 10 | 0 | H | Comparative example |
| 48 | — | 50 | 100 | 850 | 60 | 10 | 66 | H | Comparative example |
| 49 | — | 53 | 10 | 750 | 60 | 40 | 14 | B | Comparative example |
| 50 | — | 53 | 100 | 750 | 60 | 40 | 82 | B | Example of invention |
| 51 | — | 53 | 300 | 750 | 60 | 40 | 95 | B | Example of invention |
| 52 | — | 53 | 50 | 800 | 60 | 40 | 65 | B | Example of invention |
| 53 | — | 53 | 100 | 800 | 60 | 40 | 78 | B | Example of invention |
| 54 | — | 53 | 300 | 800 | 60 | 40 | 91 | B | Example of invention |

The microstructure and mechanical properties of each of the cold-rolled steel sheets manufactured as described above were investigated as follows. The results of the investigation are collectively indicated in Table 3.

An average grain diameter of ferrite, an average grain diameter of the low-temperature transformation phase and an average grain diameter of retained austenite having an aspect ratio of less than 5 in each cold-rolled steel sheet were obtained using an SEM-EBSD equipment, by referring to a structure of a cross-section parallel to a rolling direction at a depth of ¼ of a sheet thickness and the sheet thickness direction of the steel sheet. Area fractions of ferrite and the low-temperature transformation phase were also obtained using the analysis results of SEM-EBSD. Also, a volume fraction of the austenite phase was obtained by X-ray diffractometry using the later-described equipment to use the volume fraction as an area fraction of retained austenite (retainedγ). For an EB SD analysis of a structure containing the retained austenite phase, the retained austenite is concernedly not correctly measured because of disturbance at the time of sample preparation (e.g., transformation of retained austenite to martensite). Thus, in the present example, the evaluation premise that an area fraction of retained austenite obtained by an EBSD analysis (γEBSD) satisfies (γEBSD/γXRD)>0.7 relative to a volume fraction of retained austenite obtained by X-ray diffractometry (γXRD) was provided for an analysis accuracy index.

Measurement of a texture of each cold-rolled steel sheet was carried out by using X-ray diffraction on a plane at a depth of ½ of the sheet thickness of steel sheets and then using ODF (orientation distribution function) obtained by analyzing the measured results of pole figures of {200}, {110} and {211} of ferrite. From the analysis results, a ratio in intensity of each of {100}<011>, {411}<011> and {211}<011> orientations relative to a random structure not having a texture was obtained, and an average value of the ratios of the intensity was used as an average ratio of the intensity in the {100}<011> to {211}<011> orientation group. X-ray intensities of the random structure not having a texture were obtained by X-ray diffraction of powdered steel. The apparatus used for X-ray diffraction was RINT-2500HL/PC manufactured by Rigaku Corporation.

The mechanical properties of each cold-rolled steel sheet after annealing were investigated by a tensile test and a hole expanding test. The tensile test was carried out using a JIS No. 5 tensile test piece to determine a tensile strength (TS) and elongation at rupture (total elongation, El). The hole expanding test was carried out in conformity of JIS Z 2256:2010 to determine a percent hole expansion λ (%). A value of TS×El was calculated as an index for balance between the strength and the ductility, and a value of TS×λ was calculated as an index for balance between the strength and the stretch flangeability. The respective values are indicated in Table 3.

TABLE 3

| Steel | | Structure of cold-rolled steel sheet | | | | | | | | Mechanical properties of cold-rolled steel sheet | | | | | |
|---|---|---|---|---|---|---|---|---|---|---|---|---|---|---|---|
| | | Area fraction | | | | | Average grain diameter | | | | | | | | |
| sheet No | Steel type | F[1)] % | Low-temperature transformation phase % | Retained γ % | Lump-like retained γ[2)] % | $d_F$ μm | $d_{M+B}$ μm | $d_{As}$ μm | Texture[3)] — | TS MPa | El % | λ % | TS × El MPa · % | TS × λ MPa · % | Remarks |
| 1 | A | 57 | 31 | 12 | 72 | 3.6 | 1.5 | 0.9 | 3.5 | 973 | 23.5 | 40.3 | 22854 | 39155 | Example of invention |
| 2 | A | 61 | 28 | 11 | 73 | 3.2 | 1.5 | 0.8 | 3.6 | 972 | 24.4 | 38.1 | 23722 | 37041 | Example of invention |
| 3 | A | 68 | 22 | 10 | 72 | 3.7 | 1.5 | 0.8 | 4.2 | 1039 | 20.4 | 49.0 | 21192 | 50862 | Example of invention |
| 4 | A | 52 | 38 | 10 | 44 | 9.2 | 4.1 | 1.6 | 2.6 | 979 | 19.8 | 38.2 | 19375 | 37381 | Comparative example |
| 5 | A | 55 | 33 | 12 | 50 | 5.7 | 2.3 | 1.0 | 3.5 | 964 | 19.2 | 47.8 | 18513 | 46108 | Comparative example |
| 6 | A | 63 | 26 | 11 | 70 | 4.0 | 1.5 | 0.9 | 3.5 | 962 | 22.1 | 42.4 | 21265 | 40797 | Example of invention |
| 7 | A | 62 | 27 | 11 | 70 | 3.3 | 1.5 | 0.8 | 3.7 | 945 | 23.4 | 45.0 | 22118 | 42534 | Example of invention |
| 8 | A | 52 | 35 | 13 | 47 | 8.7 | 3.9 | 1.2 | 3.0 | 993 | 19.6 | 42.7 | 19457 | 42339 | Comparative example |
| 9 | A | 62 | 28 | 10 | 63 | 4.8 | 1.6 | 0.9 | 3.3 | 983 | 22.8 | 33.6 | 22412 | 33053 | Example of invention |
| 10 | A | 62 | 26 | 12 | 56 | 4.7 | 1.6 | 0.9 | 3.6 | 968 | 21.1 | 37.8 | 20425 | 36590 | Example of invention |
| 11 | B | 54 | 36 | 10 | 51 | 6.2 | 3.2 | 1.0 | 3.1 | 933 | 20.7 | 38.5 | 19317 | 35928 | Comparative example |
| 12 | B | 68 | 23 | 9 | 71 | 4.3 | 1.5 | 0.9 | 3.7 | 926 | 24.0 | 49.2 | 22231 | 45574 | Example of invention |
| 13 | B | 66 | 24 | 10 | 72 | 3.7 | 1.4 | 0.8 | 3.6 | 862 | 28.7 | 35.4 | 24745 | 30522 | Example of invention |
| 14 | B | 49 | 43 | 8 | 44 | 10.1 | 4.8 | 1.6 | 2.4 | 925 | 19.2 | 41.3 | 17760 | 38203 | Comparative example |
| 15 | B | 63 | 29 | 8 | 57 | 4.7 | 1.4 | 0.8 | 3.7 | 919 | 23.1 | 47.8 | 21227 | 43923 | Example of invention |
| 16 | B | 54 | 38 | 8 | 53 | 6.4 | 4.2 | 1.1 | 3.2 | 966 | 19.1 | 49.3 | 18451 | 47600 | Comparative example |
| 17 | B | 63 | 30 | 7 | 75 | 4.0 | 1.5 | 0.8 | 3.6 | 932 | 26.2 | 47.0 | 24411 | 43825 | Example of invention |
| 18 | B | 64 | 28 | 8 | 62 | 4.1 | 1.4 | 0.8 | 3.6 | 894 | 23.7 | 47.9 | 21188 | 42811 | Example of invention |
| 19 | C | 54 | 38 | 8 | 52 | 5.4 | 2.8 | 0.9 | 3.4 | 1058 | 16.3 | 41.8 | 17237 | 44164 | Comparative example |
| 20 | C | 67 | 24 | 9 | 73 | 3.7 | 1.4 | 0.8 | 3.8 | 975 | 21.5 | 39.4 | 20952 | 38359 | Example of invention |
| 21 | C | 66 | 26 | 8 | 72 | 3.8 | 1.5 | 0.8 | 3.8 | 970 | 22.0 | 42.0 | 21343 | 40722 | Example of invention |
| 22 | D | 54 | 34 | 12 | 52 | 5.4 | 2.3 | 1.0 | 3.4 | 929 | 20.9 | 39.7 | 19416 | 36870 | Comparative example |
| 23 | D | 62 | 27 | 11 | 69 | 4.1 | 1.5 | 0.8 | 3.4 | 928 | 22.9 | 38.4 | 21262 | 35606 | Example of invention |
| 24 | D | 65 | 26 | 9 | 74 | 4.1 | 1.5 | 0.8 | 4.4 | 967 | 21.8 | 41.6 | 21075 | 40229 | Example of invention |
| 25 | E | 49 | 38 | 13 | 55 | 5.2 | 2.6 | 0.9 | 3.3 | 1055 | 18.0 | 44.3 | 18994 | 46745 | Comparative example |
| 26 | E | 61 | 27 | 12 | 73 | 3.6 | 1.5 | 0.9 | 3.7 | 1047 | 21.8 | 41.4 | 22831 | 43358 | Example of invention |
| 27 | F | 57 | 33 | 10 | 55 | 5.1 | 2.6 | 0.9 | 3.3 | 1035 | 16.5 | 49.3 | 17079 | 50979 | Comparative example |
| 28 | F | 65 | 28 | 7 | 73 | 3.0 | 1.4 | 0.8 | 3.7 | 962 | 22.3 | 46.4 | 21454 | 44627 | Example of invention |
| 29 | F | 52 | 39 | 9 | 48 | 7.3 | 3.5 | 1.1 | 2.9 | 922 | 17.7 | 46.2 | 16325 | 42610 | Comparative example |
| 30 | F | 71 | 21 | 8 | 75 | 2.8 | 1.5 | 0.8 | 4.6 | 1000 | 24.8 | 44.8 | 24796 | 44831 | Example of invention |
| 31 | F | 65 | 28 | 7 | 77 | 4.1 | 1.5 | 0.9 | 3.4 | 918 | 24.5 | 40.8 | 22498 | 37467 | Example of invention |
| 32 | F | 55 | 36 | 9 | 57 | 5.8 | 2.8 | 1.0 | 3.4 | 969 | 17.1 | 47.3 | 16570 | 45834 | Comparative example |
| 33 | F | 66 | 28 | 6 | 80 | 3.8 | 1.4 | 0.8 | 3.8 | 934 | 23.4 | 48.2 | 21856 | 45019 | Example of invention |
| 34 | G | 56 | 35 | 9 | 62 | 5.4 | 2.5 | 1.0 | 3.0 | 844 | 23.8 | 37.8 | 20094 | 31872 | Comparative example |
| 35 | G | 66 | 26 | 8 | 75 | 3.9 | 1.4 | 0.8 | 3.5 | 881 | 27.6 | 48.2 | 24311 | 42479 | Example of invention |
| 36 | H | 51 | 38 | 11 | 57 | 6.1 | 3.1 | 1.3 | 2.8 | 1070 | 17.1 | 42.2 | 18299 | 45158 | Comparative example |
| 37 | H | 60 | 29 | 11 | 72 | 3.7 | 1.5 | 0.8 | 3.5 | 1035 | 20.2 | 45.8 | 20899 | 47385 | Example of invention |
| 38 | H | 67 | 25 | 8 | 78 | 3.5 | 1.4 | 0.8 | 3.5 | 1044 | 21.3 | 44.9 | 22246 | 46894 | Example of invention |
| 39 | H | 65 | 26 | 9 | 80 | 3.4 | 1.4 | 0.8 | 3.6 | 1027 | 20.7 | 47.2 | 21257 | 48470 | Example of invention |
| 40 | I | 53 | 38 | 9 | 56 | 5.7 | 2.9 | 1.3 | 2.9 | 792 | 21.0 | 51.2 | 16622 | 40525 | Comparative example |
| 41 | I | 57 | 34 | 9 | 72 | 2.9 | 1.6 | 0.9 | 3.8 | 782 | 26.2 | 49.3 | 20491 | 38558 | Example of invention |
| 42 | J | 60 | 35 | 5 | 60 | 6.5 | 3.2 | 1.2 | 3.1 | 835 | 16.3 | 58.2 | 13611 | 48597 | Comparative example |

TABLE 3-continued

| Steel sheet No | Steel type | Structure of cold-rolled steel sheet: Area fraction: F[1)] % | Low-temperature transformation phase % | Retained γ % | Lump-like retained γ[2)] % | Average grain diameter: $d_F$ μm | $d_{M+B}$ μm | $d_{As}$ μm | Texture[3)] — | Mechanical properties of cold-rolled steel sheet: TS MPa | El % | λ % | TS × El MPa · % | TS × λ MPa · % | Remarks |
|---|---|---|---|---|---|---|---|---|---|---|---|---|---|---|---|
| 43 | J | 70 | 25 | 5 | 73 | 4.3 | 1.5 | 0.8 | 3.4 | 823 | 23.9 | 54.1 | 19658 | 44497 | Example of invention |
| 44 | J | 66 | 28 | 6 | 75 | 3.5 | 1.9 | 1.2 | 3.6 | 810 | 24.2 | 55.6 | 19604 | 45042 | Example of invention |
| 45 | K | 60 | 35 | 5 | 74 | 3.6 | 1.5 | 0.9 | 5.2 | 1022 | 18.2 | 36.2 | 18600 | 36996 | Comparative example |
| 46 | K | 62 | 32 | 6 | 76 | 3.3 | 1.4 | 0.8 | 5.5 | 1019 | 17.3 | 39.6 | 17629 | 40352 | Comparative example |
| 47 | L | 91 | 9 | 0 | — | 7.4 | 3.7 | 0.8 | 2.3 | 431 | 30.8 | 101.0 | 13281 | 43551 | Comparative example |
| 48 | L | 92 | 8 | 0 | — | 7.0 | 3.3 | 0.8 | 2.3 | 436 | 31.0 | 102.0 | 13525 | 44503 | Comparative example |
| 49 | M | 78 | 11 | 11 | 89 | 6.2 | 1.8 | 1.0 | 8.2 | 725 | 24.2 | 78.9 | 17540 | 57187 | Comparative example |
| 50 | M | 73 | 19 | 9 | 92 | 4.1 | 1.4 | 0.9 | 12.3 | 749 | 25.9 | 75.3 | 19386 | 56362 | Example of invention |
| 51 | M | 67 | 23 | 8 | 93 | 3.6 | 1.3 | 0.9 | 13.2 | 771 | 26.1 | 72.1 | 20113 | 55560 | Example of invention |
| 52 | N | 72 | 17 | 11 | 93 | 4.7 | 1.5 | 0.9 | 9.5 | 603 | 34.2 | 99.2 | 20636 | 59857 | Example of invention |
| 53 | N | 69 | 21 | 10 | 94 | 4.3 | 1.3 | 0.9 | 10.3 | 618 | 35.4 | 96.1 | 21884 | 59409 | Example of invention |
| 54 | N | 61 | 29 | 10 | 94 | 3.9 | 1.3 | 0.8 | 10.9 | 627 | 36.2 | 93.5 | 22712 | 58662 | Example of invention |

(Notes)
1)F: ferrite
2)Lump-like retained γ: Area fraction of retained γ having an aspect ratio of less than 5 relative to all retained γ
3)Texture: Average X-ray intensity ratio of the {100}<011> to {211}<011> orientation group In steel sheets Nos. 5, 8, 11, 14, 16, 19, 22, 25, 27, 32, 34, 36, 40, 42, 47 and 49, the heating rate during annealing was less than 15° C./sec, and thus, the proportion of the unrecrystallization at $Ac_1$+10° C. was less than 30%. Thus, the microstructure of the cold-rolled steel sheet coarsened and the average grain diameter of ferrite exceeds the upper limit defined by the present invention. As a result, the mechanical properties were inferior.

In steel sheets Nos. 4 and 29, the heating rate during annealing was at least 15° C./s, but since the annealing temperature exceeded $Ac_3$+100° C., the microstructure of the cold-rolled steel sheet coarsened and the grain diameter of ferrite exceeded the upper limit defined by the present invention. As a result, the mechanical properties were inferior.

In steel sheets Nos. 45 and 46, the Nb content exceeded the upper limit, and thus the steel was excessively hardened, resulting in deteriorating workability. As a result, the mechanical properties of the cold-rolled steel sheet were low irrespective of the heating rate.

In steel sheets Nos. 47 and 48, the Si content was lower than the lower limit, and thus retained austenite was formed in the cold-rolled steel sheet. Thus, the ductility was low. As a result, the mechanical properties of the cold-rolled steel sheet were low irrespective of the heating rate.

On the other hand, the steel sheets having the chemical composition and structure defined by the present invention, while having high strength, had, in particular, significantly excellent ductility compared to the comparative examples and favorable stretch flangeability as can be seen in comparison with those of the same steel types.

The invention claimed is:

1. A cold-rolled steel sheet characterized by having:

a chemical composition comprising, in mass %, C: 0.06 to 0.3%, Si: 0.4 to 2.5%, Mn: 0.6 to 3.5%, P: at most 0.1%, S: at most 0.05%, Ti: 0 to 0.08%, Nb: 0 to 0.04%, a total content of Ti and Nb: 0 to 0.10%, sol.Al: 0 to 2.0%, Cr: 0 to 1%, Mo: 0 to 0.3%, V: 0 to 0.3%, B: 0 to 0.005%, Ca: 0 to 0.003%, REM: 0 to 0.003% and the remainder of Fe and impurities, a microstructure having a main phase of ferrite comprising at least 40 area %, and a second phase of a low-temperature transformation phase consisting either or both of martensite and bainite which comprising at least 10 area % in total and retained austenite at least which comprising 3 area %, and satisfying Equations (1) to (4):

$$d_F \leq 5.0 \quad (1);$$

$$d_{M+B} \leq 2.0 \quad (2);$$

$$d_{As} \leq 1.5 \quad (3); \text{ and}$$

$$r_{As} \geq 50 \quad (4),$$

where $d_F$ is an average grain diameter (μm) of ferrite defined by high angle grain boundaries having a tilt angle of at least 15°;

$d_{M+B}$ is an average grain diameter (μm) of the low-temperature transformation phase;

$d_{As}$ is an average grain diameter (μm) of retained austenite having an aspect ratio of less than 5; and $r_{AS}$ is an area fraction (%) of retained austenite having an aspect ratio of less than 5 relative to all the retained austenite, wherein, the cold-roiled steel sheet has a texture whose ratio of an average X-ray intensity of {100}<011> to {211}<011> orientations relative to an average X-ray intensity of a random structure having no texture is less than 6 at a death of ½ of a sheet thickness, and the cold-rolled steel sheet has a tensile strength of at least 782 MPa.

2. The cold-rolled steel sheet as set forth in claim 1, wherein the chemical composition contains one or two selected from, in mass %, Ti: 0.005 to 0.08% and Nb: 0.003 to 0.04%.

3. The cold-rolled steel sheet as set forth in claim 1, wherein the chemical composition contains, in mass %, sol.Al: 0.1 to 2.0%.

4. The cold-rolled steel sheet as set forth in claim 1, wherein the chemical composition contains one or more selected from, in mass %, Cr: 0.03 to 1%, Mo: 0.01 to 0.3% and V: 0.01 to 0.3%.

5. The cold-rolled steel sheet as set forth in claim 1, wherein the chemical composition contains, in mass %, B: 0.0003 to 0.005%.

6. The cold-rolled steel sheet as set forth in claim 1, wherein the chemical composition contains one or two selected from, in mass %, Ca: 0.0005 to 0.003% and REM: 0.0005 to 0.003%.

7. The cold-rolled steel sheet as set forth in claim 1, comprising a plating layer on a sheet surface.

* * * * *